US006240273B1

(12) United States Patent
Kakigi

(10) Patent No.: US 6,240,273 B1
(45) Date of Patent: May 29, 2001

(54) IMAGE FORMING APPARATUS FOR EJECTING A SHEET FORMED WITH AN IMAGE TO ANY OF A PLURALITY OF LOADING UNITS

(75) Inventor: Nobuyoshi Kakigi, Sakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/359,735

(22) Filed: Jul. 23, 1999

Related U.S. Application Data

(62) Division of application No. 09/064,307, filed on Apr. 23, 1998, now Pat. No. 5,946,541.

(30) Foreign Application Priority Data

Apr. 30, 1997 (JP) ..... 9-112491

(51) Int. Cl.[7] ..... G03G 15/00

(52) U.S. Cl. ..... 399/405; 271/279; 358/1.13; 358/1.14; 399/20; 399/82; 399/410

(58) Field of Search ..... 399/407, 410, 399/405, 19, 18, 20, 82, 85; 358/1.13, 1.14; 271/279, 298

(56) References Cited

U.S. PATENT DOCUMENTS

| | | | | |
|---|---|---|---|---|
| Re. 34,460 | * | 11/1993 | Ishiguro et al. | 399/410 X |
| 4,329,046 | | 5/1982 | Burkett et al. | 399/85 X |
| 5,151,735 | * | 9/1992 | Yamashita et al. | 399/18 |
| 5,204,728 | | 4/1993 | Braswell | 399/75 |
| 5,640,232 | | 6/1997 | Miyaka et al. | 399/18 |
| 5,729,791 | | 3/1998 | Kutsuwada et al. | 399/82 |

* cited by examiner

*Primary Examiner*—Susan S. Y. Lee
(74) *Attorney, Agent, or Firm*—Fitzpatrick, Cella, Harper & Scinto

(57) ABSTRACT

An image forming device inputs data and has a mechanism for ejecting a sheet on which an image is formed to one of a first loading unit or a second loading unit, wherein if the load quantity of the first loading unit reaches a predetermined load quantity while a plurality of sheets are being continuously ejected to the first loading unit, then a sheet can be ejected successfully to the second loading unit. A controller is provided for ejecting the sheet to the second loading unit in a different ejecting way from the sheets ejected to the first loading unit when the sheet to be ejected to the second loading unit is a part of the same job as the sheets ejected to the first loading unit.

44 Claims, 11 Drawing Sheets

IMAGE FORMING APPARATUS FOR EJECTING A SHEET FORMED WITH AN IMAGE TO ANY OF A PLURALITY OF LOADING UNITS

This application is a division of Ser. No. 09/064,307 Apr. 23, 1998 U.S. Pat. No. 5,946,541.

BACKGROUND OF THE INVENTION

1. Field of the Invention

The present invention relates to an image forming apparatus for ejecting (discharging) a sheet formed with an image to any of a plurality of loading (carrying) units.

2. Description of the Related Art

In many conventional image recording apparatus, a host computer and an image recording apparatus are connected one-by-one, and most image recording apparatuses have only one ejection tray, and the image recording apparatuses eject the sheets for a plurality of jobs to that ejection tray.

Also, there has been proposed an image forming apparatus which has a plurality of ejection trays and which ejects the sheets to designated trays for sorting the sheets for a plurality of jobs.

Further, there has been proposed an image forming apparatus that controls a plurality of ejection trays, for enabling the apparatus to eject as many sheets as possible without sorting, and regardless of the breaks of jobs, by ejecting the sheets continuously into one of the ejection trays until the one of the ejection trays is detected as fully-loaded, and of ejecting the sheets to other one of the ejection trays when detected as fully-loaded.

This apparatus is capable of loading as many sheets as possible, but there is also a possibility that the sheets for one job are ejected into a plurality of ejection trays separately, therefore it is likely that an user will not notice the above fact and thus will take the sheets out from one ejection tray thinking it is the entire job.

SUMMARY OF THE INVENTION

Accordingly, it is an object of the present invention to provide an image forming apparatus which has solved the above mentioned problem.

It is another object of the present invention to provide an image forming apparatus capable of preventing sheets from not being taken out of the trays, which is easily occurred in a situation that the sheets for one job are ejected into a plurality of loading unit, without changing the location to which the sheets are ejected as being reached to a predetermined loading capacity.

It is yet another object of the present invention to provide an image forming apparatus capable of preventing the sheets being not taken out without ejecting the sheets for one job to a plurality of carrying units, as well as capable of implementing a maximum load of sheets on a first loading unit.

In accordance with one aspect of the invention, there is provided an image forming apparatus with image forming means for forming an image on a sheet, ejecting means for ejecting the sheet to one of a first loading unit and a second loading unit, detecting means for detecting that a load of the first loading unit has reached a predetermined quantity, and controlling means for controlling the ejecting means such that when the detecting means detects that the load of the first loading unit has reached the predetermined quantity while continuously ejecting a plurality of sheets formed with images of a first job to the first loading unit, the remaining sheets of the first job are also ejected to the first loading unit and sheets formed with images of a second job which is begun following the first job are ejected to the second loading unit.

In accordance with another aspect of the invention, there is provided an image forming apparatus with image forming means for forming an image on a sheet, ejecting means for ejecting the sheet on which the sheet is formed by the image forming means to one of a first loading unit and a second loading unit, and controlling means for controlling the ejecting means such that sheets for one job are ejected to one of the first loading unit and the second loading unit in order that a plurality of sheets for the one job are not ejected separately to the first loading unit and the second lading unit in accordance with a maximum load quantity of the first loading unit.

The other objects and features of the present invention will be apparent from the following description of the specification and the accompanying drawings.

DESCRIPTION OF THE PREFERRED EMBODIMENTS

[A first embodiment]

Figure 1:
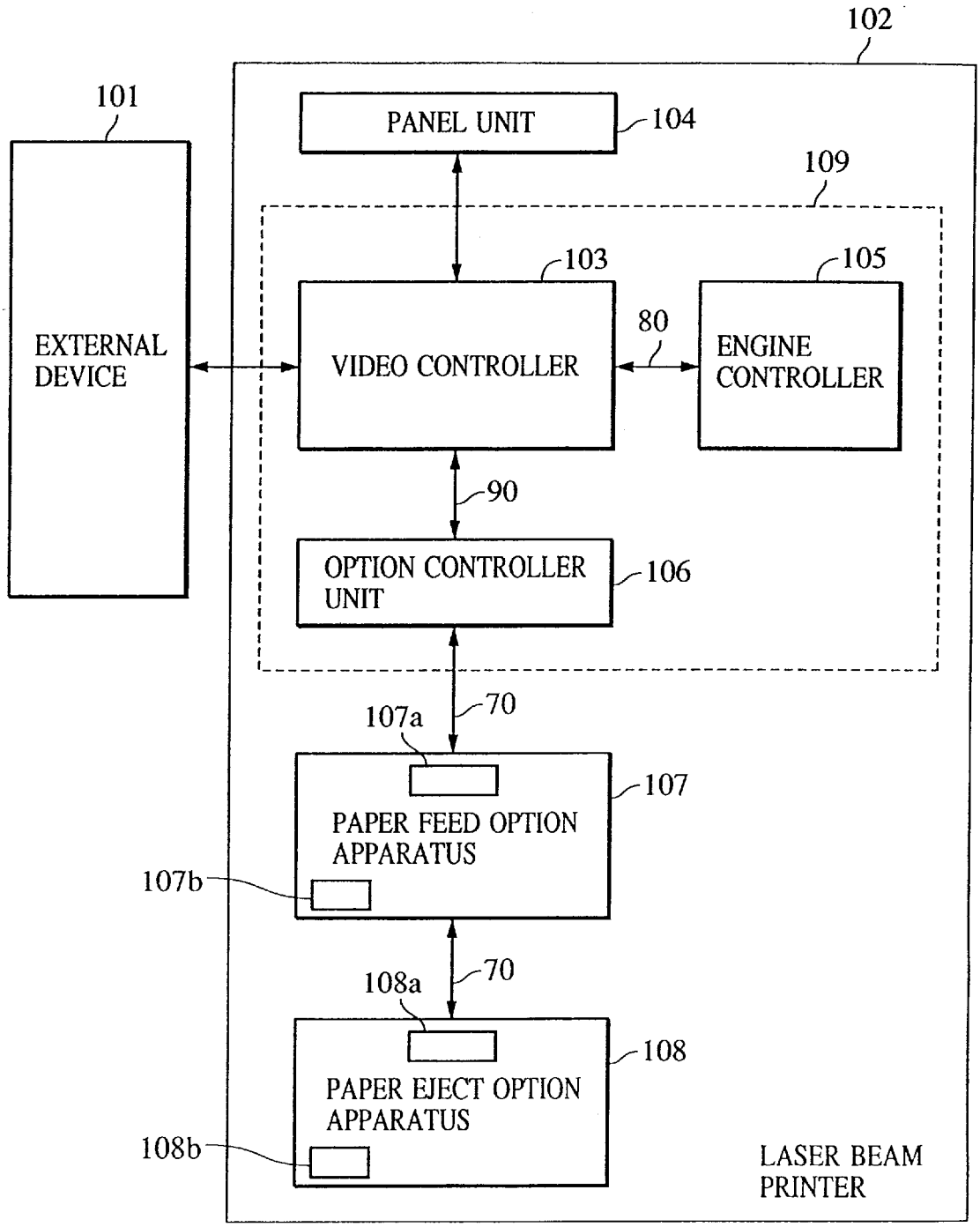
FIG. 1 is a block diagram illustrating a configuration of an image recording apparatus showing a first embodiment according to the present invention.

FIG. 1 is a block diagram of an image recording apparatus showing a first embodiment of the present invention, and for example, illustrating a case of a laser printer.

In the figure, a numeral 102 indicates a laser beam printer (printer) that connects various types of option apparatuses, and is connected to an external device 101 such as a host computer and the like by a general purpose interface (for example the centronics, RS232C, etc.), and implementing image recording on the basis of print data (a control information of a code data and the like on a basis of a predetermined printer language (PDL), for example, including the PostScript, the LIPSIII, IV (trade name), and an image data) which is transferred from the external device 101 through the general purpose interface. Video controller 103 is connected to the external device 101 via the general purpose interface, and video controller 103 receives print data (the ESC code, various types of PDL data, etc.) from external device 101 through the general purpose interface, and generating printing information composed of the dot data on a basis of the print data, as well as generating page information which represents an information of a control required for an image recording of each page. Page information includes, for example, a job ID which identifies a break of a job, feed paper designation information, and ejection paper designation information which indicates from where a sheet is fed and to where the sheet is ejected.

The video controller 103 transmits printing information (binary or multivalues) to an engine controller 105 (which will be described later) through the video interface 80. Further, the video controller 103 transmits feed paper designation commands and ejection paper designation commands to an option controller unit 106 which will be described later through the generalized interface 90 on a basis of the page information. The engine controller 105 forms a latent image on a photosensitive drum by any known electrophotographic process, on the basis of the print data which is transferred from the video controller 104, and implements a printing by imprinting (transferring) and fusing the formed latent image on a sheet to be fed. The engine controller 105, in association with an image forming operation, implements an instruction of a feed/ejection paper timing to the option controller unit 106 through the video controller 103.

Panel unit 104 is a user interface, which is configured of various types of switches (buttons) for operations and has an LCD display device or the like, and thus the user can input a designated operation to be performed by the printer 102 by manipulating the panel unit 104. Further, the various types of data and the like which are set by the user are stored and managed in a non-volitile memory (not shown) such as the NVRAM, EEPROM and the like.

The option controller 106 contains a CPU, a ROM, a RAM and the like, and is a general purpose controller which controls one or more option apparatus (unit) on a basis of the feed/ejection sheet designation or other signals which are transferred from engine controller 105 by the video controller 103, and controls the various types of option apparatuses by communicating with the option controller unit 106 of the option possessed in the various types of options through the option unit interface 70.

Further, within the RAM of the option controller unit 106, there is a common memory to which the video controller is capable of accessing, and the common memory consists of a carrier status management area for about 40 pages, a basic status area, a command status management area, a start-up process area and the like, and the video controller 103 implements a designation to each option apparatus through each area of the common memory.

The carrier status management area consists of an area of which the video controller 103 notifies a printing method (a paper feed inlet, a paper ejection outlet, a color, stapling, shifting, etc.) to each option apparatus, and an area of which notifies each option state (to what extent a printing is made, ejecting a paper is completed, etc.) to the video controller 103.

The basic status area is an area which notifies the video controller 103 of an abnormality of each option apparatus, and the command and status management area is an area which implements an exchange of a command status with the video controller 103, and the start-up process area is an area of which the video controller 103 designates a start-up process of each option apparatus A numeral 107 indicates a paper feed option apparatus (paper deck option unit), has a paper deck controller (large capacity cassette controller) 107*a* inside thereof, and implements a paper feed control based on a control information transmitted from the option controller unit 106. Further, the paper deck controller 107*a* includes a CPU, a ROM, and a RAM which are not shown, and the CPU controls the paper feed option apparatus 107 based on a program stored in the ROM. Also, in the ROM, information of the paper feed option apparatus 107, for example, the information of a sheet size which is storable in the paper deck and the like is being stored.

Paper ejection option apparatus 108 (finisher option unit), has a finisher controller (large capacity paper ejection stacker controller) 108*a* inside thereof, and implements a paper ejection operation based on control information transmitted from the option controller unit 106. More details of the paper ejection option apparatus will be described later. Further, the finisher controller 108*a* includes a CPU, a ROM, and a RAM which are not shown, and the CPU controls the paper ejection option apparatus 108 based on a program stored in the ROM. There is stored in the ROM, information of the paper ejection option apparatus 108, for example, information of the number of paper ejection bins, of whether or not there is a stapling ability (function), of whether or not there is a shifting ability for shifting the paper ejection sheet in a predetermined direction, and of whether or not there is a reversing ability for reversing a face direction of a paper ejection sheet, and the like.

Display means 107*b* and 108*b* are disposed in the paper feed option apparatus 107 and the paper ejection option 108, respectively, and are capable of displaying a message for a user while using each option.

A numerical 109 indicates a control unit, and consists of the engine controller 105 for implementing a printing process control of the printer 102, the video controller 103 for analyzing and converting an overall control of the printer 102 and data from the external device 101 to an image data, and the option controller unit 106 for generalizing and controlling each option unit.

Further, the option controller 106 manages each option unit by a common option unit interface 70, and communicates with the video controller 103 through the generalized interface 90. In the present embodiment, the video controller 103 controls each paper feed/ejection option unit by way of the option controller unit 106.

Figure 2:
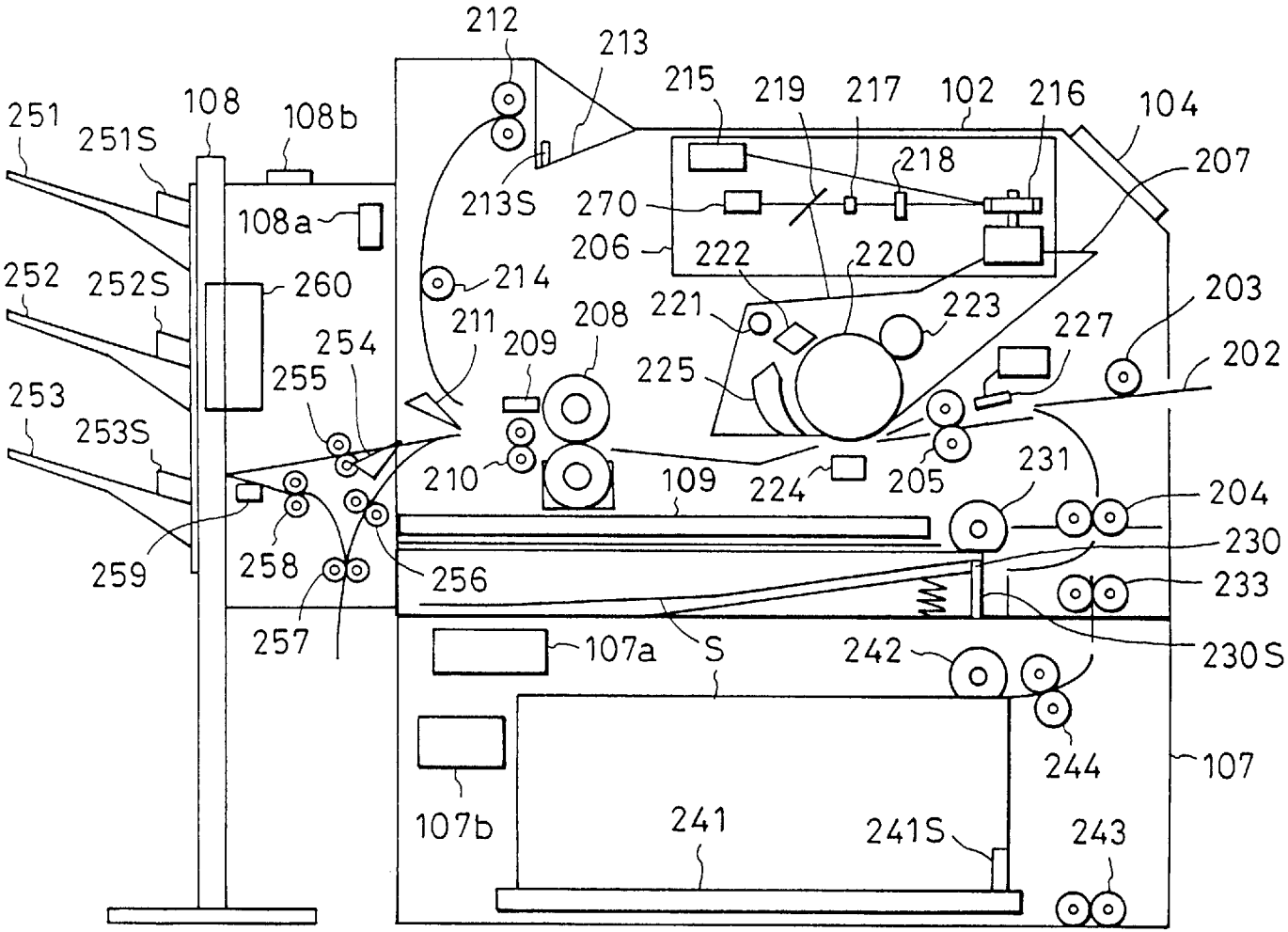
FIG. 2 is a cross-sectional view illustrating a configuration of a printer shown in FIG. 1.

FIG. 2 is a cross sectional view illustrating a configuration of the printer 102 shown in FIG. 1, and the for the same elements as in FIG. I are labelled with the same reference numbers and symbols.

In the figure, a numeral 230 indicates a sheet cassette, holds recording papers S, and has a mechanism for electrically detecting a size of the recording papers S by a partition plate (not shown).

A numeral 231 indicates a cassette paper feed cut-out roller, and is a cam for separating only one sheet of recording paper at the top of the recording sheets S placed on the sheet cassette 230, and for carrying the separated recording paper S to a paper feed roller 204 by a driving means (not shown), and rotates intermittently for each time of paper feeding, and paper feeds one sheet of the recording paper corresponding to one rotation. A numeral 230S is a recording paper detection sensor and detects a quantity of the recording sheets S being held on the sheet cassette 230.

A numeral 227 indicates a resist-shutter and presses down the sheets and stops the paper feeding. The paper feed roller 204 carries tip portions of the recording sheets S to the resist-shutter 227. A tray 202 is provided for manual insertion of recording sheets S, and the user manually places the recording sheets S thereon. A numeral 203 indicates a manual insertion paper feed roller and carries the recording papers S placed on the manual insertion tray 202 for insertion to the resist-shutter 227. A numeral 233 is an option paper feed roller (a paper feed interchange carrier roller), and feeds the recording sheets S which are paper fed from the paper feed option apparatus 107 into the main body of the printer 102.

Also, downstream of the manual insertion paper feed roller 203, the cassette paper feed cut-out roller 231, and the option paper feed roller 233, there is a resist-roller 205 for synchronously carrying the recording papers S, and downstream of resist-roller 205, there is image recording unit 207 for forming a toner image on the recording sheet S with a well-known electronics-photo process, by a laser beam emitted from the laser scanner unit 206 is provided.

In the laser scanner unit 206, a numeral 215 indicates a laser unit, and emits a laser beam based on an image signal (VDO signal) transmitted from the video controller 103. The laser beam emitted from the laser unit 215 is scanned by a polygon mirror 216, and forms a latent image on the photosensitive drum 220 through an image forming lens group 218 and a folded mirror 219. A numeral 217 indicates a beam detector, and detects the laser beam emitted from the laser unit 215 and outputs a horizontal scanning synchronizing signal. A numeral 270 indicates a light quantity sensor, and detects the quantity of light of the laser beam emitted from the laser unit 215.

Further, in the image recording unit 207, primary charger 222 charges the photosensitive drum 220 uniformly. A numeral 223 indicates a developer, and is charged by the primary charger 222, and toner-developes the latent image formed on the photosensitive drum 220, which is laser-exposured by the laser scanner unit 206. A numeral 224 indicates a transfer charger, and transfers the toner image on the photosensitive drum 220 developed by the developer 223 onto the recording sheet S paper-fed by the resist-roller pair 205. A numeral 225 indicates a cleaner that removes the remaining toners on the photosensitive drum 220. A numeral 221 indicates a pre-exposure lamp, and photo-discharges the photosensitive drum 220.

Fuser 208 thermal-fuses the latent image formed on the recording sheet S by the image recording unit 207 on to the recording sheet S. A numeral 210 is a carrier roller, and paper-ejects and carries the recording sheet S. Paper-ejection sensor 209 detects a paper-ejection state of the recording sheet S. A numeral 211 is a flapper, and switches a carrier direction of the recording sheet S of which a recording is completed between the paper ejection tray 21 side and the paper ejection option apparatus 108 side. Numerals 214 and 212 are paper-ejection rollers which paper-eject the recording sheet S to the paper-ejection tray 213. A numeral 213S indicates a paper-ejection load quantity detection sensor, and detects a load quantity of the recording sheets loaded on the paper-ejection tray 213.

The engine controller 105 within the control unit 109 (see FIG. 1) implements a control of an electronic-photo process by the laser scanner unit 206, the image recording unit 207, the fuser 208, as well as a carrier control of the recording papers within the main body of the printer 102.

Further, the video controller 103 is connected with an external device 101 such as a personal computer by the general purpose interface (for example, the centronics, RS 232C, etc.), translates the print data transmitted through the general purpose interface to the bit data printing information, and transmits that bit data as the VDO signal to the engine controller 105 through the video interface 80.

Next, the various types of option units which are connected as attachable/detachable to the printer main body 102 will be described.

The option controller unit 106 shown in FIG. 1 is disposed within the printer main body 102 shown in FIG. 2, and is configured to enable the various types of option units to be communicated with using the same protocol through the option unit interface 70 which turns to be a common bus. Also, the option controller 106 is connected to the video controller 103 through the generalized interface 90.

In the paper-feed option apparatus 107 such as the paper deck option unit and the like, a paper deck 241 loads the recording sheets S in a large capacity on the paper deck 241 which goes up and down. A numeral 242 indicates a paper deck paper-feed roller which feeds the recording sheets S loaded on the paper deck 241. A numeral 244 indicates a carrier roller, and carries the recording sheet S paper-fed from the paper deck paper-feed roller 242 in the direction of the option paper-feed roller 233. A numeral 243 indicates a paper-feed interchange carrier roller, and interchange-carries the recording sheet paper fed from other paper-feed family option unit (which is capable of paper-feeding the recording sheets of different sizes or of the same size) which are multi-connectable as attachable/detachable to the bottom of the paper deck option unit 107. Also, a numeral 241S indicates a recording sheet storage quantity detection sensor, and detects a load quantity of the recording sheets S loaded on the paper deck 241. In a case that the paper-feed family option units are piled several levels high, because a distance from the unit located at a lower level to the printer 102 becomes large, when paper-feeding from the unit located at lower lever in the next job of the job in the progress, it is so controlled to paper-feed before the job in the progress is completed.

Further, the paper deck option unit 107 is controlled by the paper deck controller 107*a*.

In a paper-ejection option apparatus 108 which may be a finisher option unit, a numeral 251 indicates a first paper ejection bin, a numeral 252 indicates a second paper ejection bin, and a numeral 253 indicates a third paper ejection bin. Together the bins are the ones which load the recorded recording sheets S by sorting. A numeral 260 indicates a bin ascending and descending motor, and effects sorting of the recording sheets S into each bin by moving the paper-feed bins 251–253 up and down. A numeral 254 indicates a flapper, and implements a carrier switch of the recording papers S allotted by the flapper 211 of the printer main bodiy 102 and transmitted to the finisher option unit 108 so as to implement a face switching of a sheet based on an instruction from the video controller 103. Further, numerals

251S–253S are paper ejection load quantity detection sensors that detect a load quantity of the recording sheets loaded on the paper-ejection bins 251–253, respectively.

The paper-ejection load quantity detection sensors 251S–253S are the sensors which detect the height of the recording sheets. When the recording sheets loaded on the first paper ejection bin 251-the third paper ejection bin 253 reach the maximum height (are detected as), for example, 88 mm (corresponding to about 700 sheets), the finisher controller 108*a* notifies the video controller 103 of a full load through the option controller 106.

Further, the first paper ejection bin 251-the third paper ejection bin 253 are capable of holding about 700 sheets in each bin, i.e., about 2000 sheets for three bins, but in a case that the staple processed sheets are being loaded, because there is a possibility of the load collapsing at a time when moving the bin by the bin ascending and descending motor 206, a detection criteria of the full-load for the sheets loaded on each bin might be a half of the normal case (herein, 88 mm), 44 mm.

In the case where a face-up designation has been made through a generalized interface 90 by the video controller 103, the recording sheets S are directed to the roller 255 by the flapper 254, and transmite to the paper ejection outlet as they are. In a case where a face-down designation has been made by the video controller 103 through the generalized interface 90, the sheets S are directed to the rollers 256 and 527 by the flapper 254, and are temporarily carried until the ends of the sheets S extend beyond roller 256, and the sheets S are then reversed and sent into the roller 258 by reverse rotation of the roller 257, and then transmitted to the paper ejection outlet.

A numeral 259 indicates a stapler, When stapling is designated, the recording sheets S are stocked in a staple tray (not shown), and by arranging the recording sheets S, the stapler 259 staples the recording sheets S, and paper ejects the stapled sheets to any of the first paper ejection bin 251 to the third paper ejection bin 253. Further, in case of being a shift-designated through the generalized interface 90 by the video controller 103, as in the case of being a staple-designated, by stocking the recording sheets S in a staple tray (not shown), and by arranging the recording sheets S, then by sliding the trays (the first paper ejection bin 251 to the third paper ejection bin 253), that is, by sliding the load areas (tray) of the recording sheets S to be paper ejected, then paper ejecting to any of the first paper ejection bin 251 to the third paper ejection bin 253.

Moreover, the finisher option unit 108 is controlled by a finisher controller 108*a*.

Further, the option controller unit 106, the paper deck controller 107, the finisher controller 108 are respectively connected with the connectors, and implement serial communication by the option unit interface 70. Each option unit is connected in series each other by the same connector, therefore, the paper deck option unit 107 and the finisher option unit 108 are also capable of being connected by exchanging the connection orders thereof.

Figure 3:
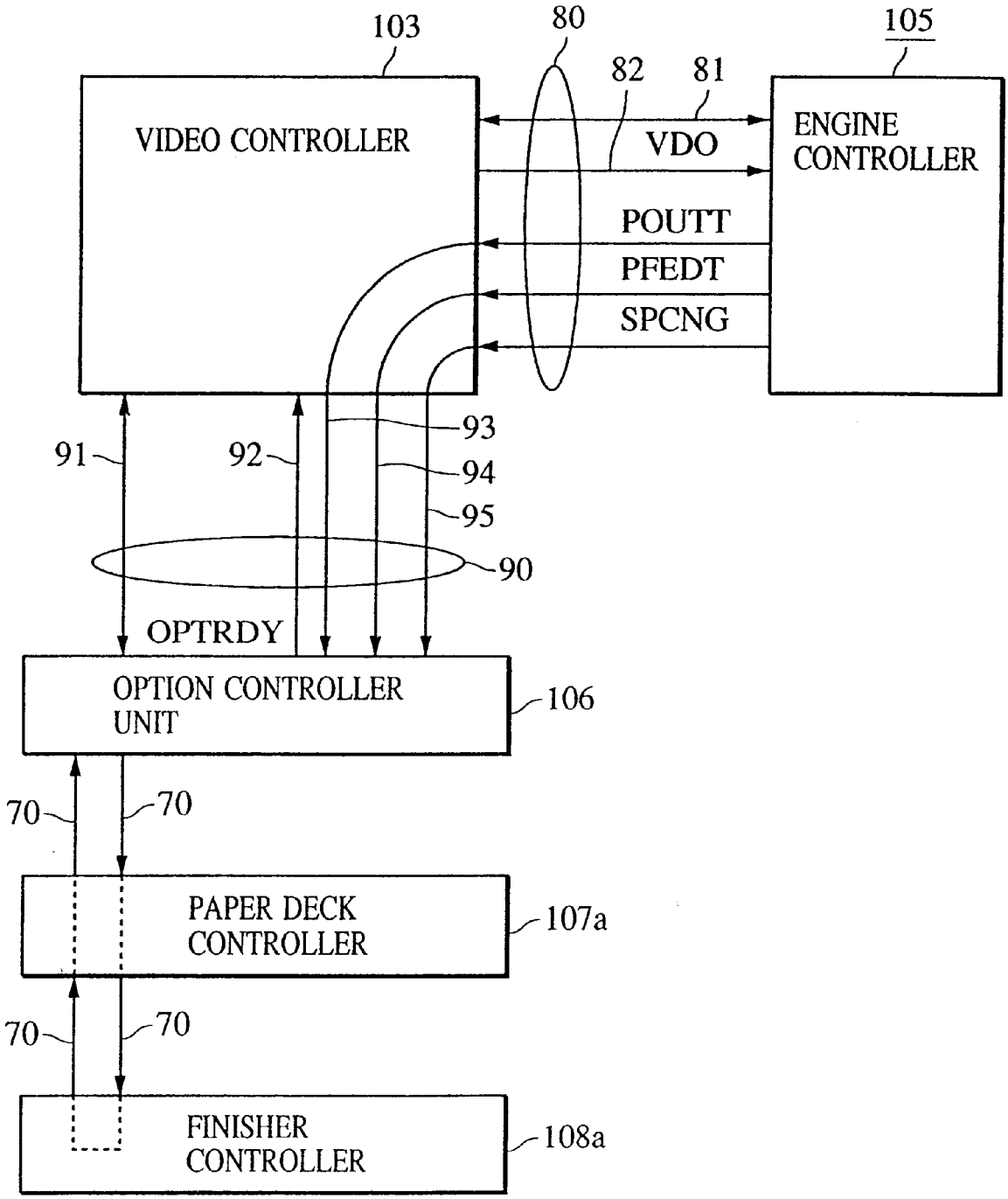
FIG. 3 is a block diagram illustrating a configuration of a printer shown in FIG. 1.

FIG. 3 is a block diagram illustrating a configuration of the printer 102 shown in FIG. 1, and the same elements in FIG. 1 are labelled with the same reference numbers/symbols.

In the figure, a numeral 91 indicates a serial communication interface whereby commands such as a paper feed designation to the paper deck option unit 107 and a paper ejection bin designation to the finisher option unit 108 are transmitted from the video controller 103 to the option controller unit 106. The statuses such as a paper presence/absence state of the paper deck option unit 107 and a load state of each paper ejection bin of the finisher option unit 108 are also transmitted from the option controller unit 106 to the video controller 103 via serial communication interface 91. Further, the option controller unit 106 and the video controller 103 may be directly connected by a CPU bus.

A numeral 92 indicates-an OPTRDY signal, and functions as a signal indicating whether or not an option designated by the video controller 103 becomes a usable state, and is transmitted from the option controller unit 106 to the video controller 103. A numeral 93 indicates a POUTT signal, and functions as a timing signal for which the printer main body 102 paper ejects the recording sheet. A numeral 94 indicates a PFEDT signal, and functions as a timing signal for which the printer main body 102 receives the recording sheet from the option unit. A numeral 95 indicates a SPCNG signal, and functions as a signal for slowing down the recording sheet S being carried in high-speed within the option unit, and for matching with a carrier speed of the printer main body 102.

A numeral 81 indicates a communication interface, and the commands of a paper feed designation to the paper feed cassette of the printer main body 102 and a paper ejection designation to the paper ejection tray 231 of the printer main body 102 and the printings, are transmitted from the video controller 103 to the engine controller 105, and a status, such as a paper presence/absence state of the paper feed cassette 230 of the printer main body 102 or a paper jam, are transmitted from the engine controller 105 to the video controller 103. A numeral 82 indicates a VDO signal, and represents a video data to be transmitted from the video controller 103.

Further, the generalized interface 90 comprises the five hard signals of the serial communication interface 91, the OPTRDY signal 92, the POUTT signal 93, the PFEDT signal 94, and the SPCNG signal 95.

Moreover, the POUTT signal 93, the PFEDT signal 94, and the SPCNG signal 95 are output from the engine controller 105, via the video interface 80, through the video controller 103, and input to the option controller unit 106.

Figure 4:
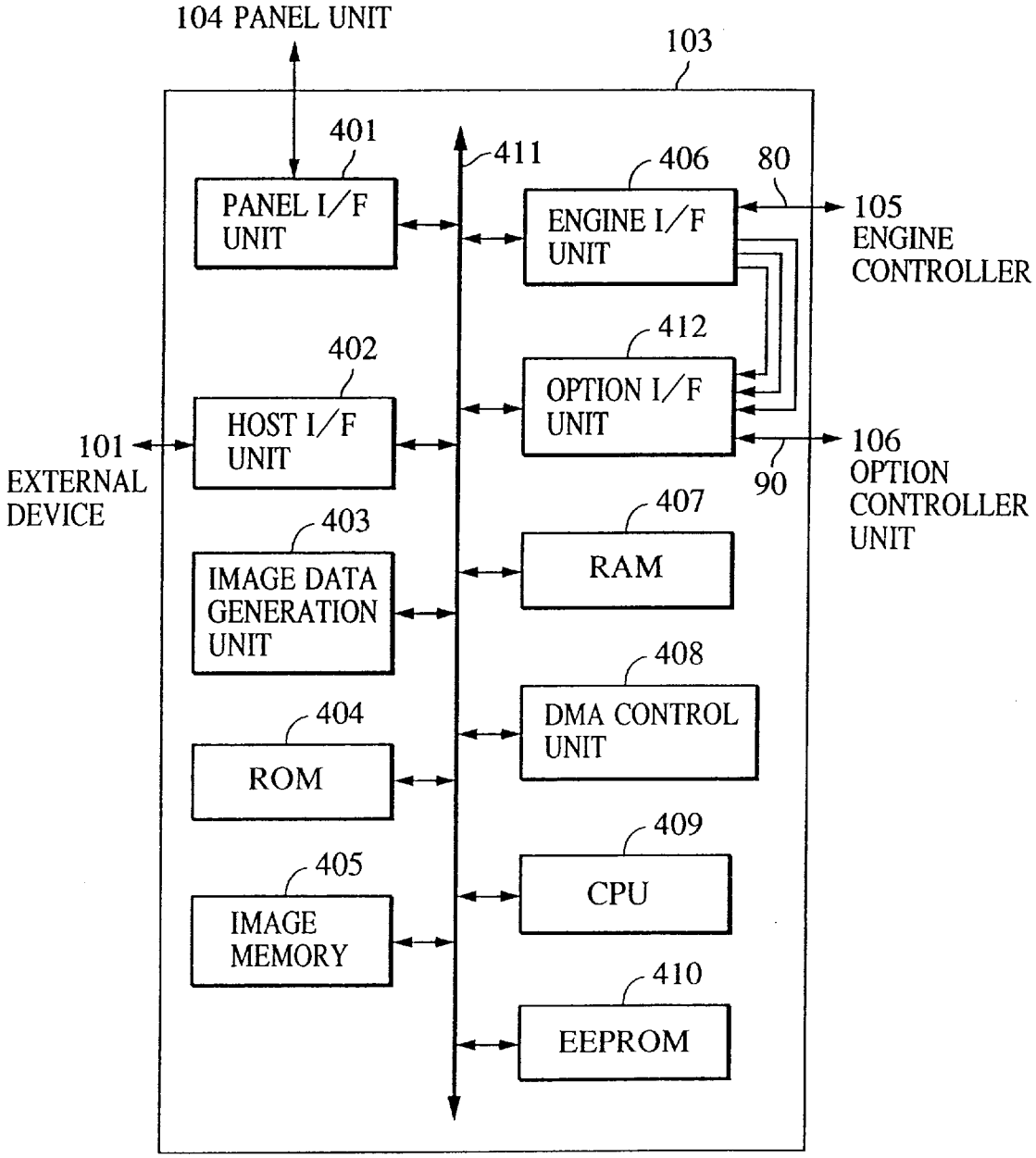
FIG. 4 is a block diagram illustrating a configuration of a video controller shown in FIG. 1.

FIG. 4 is a block diagram illustrating a configuration of the video controller 103 shown in FIG. 1, and the same elements in FIG. 1 are labelled with the same reference numbers/symbols.

In the figure, panel interface (I/F) unit 401 receives the various settings and instructions from an operator through the panel unit 104, by the data communication with the panel unit 104. A numeral 402 indicates a host interface (I/F) unit which is an input/output (I/O) unit for a signal with the external device 101 such as a host computer and the like. Engine interface (I/F) unit 406 and is a signal input unit with the engine controller 105, and implements a data signal transmission from an output buffer register (not shown) and also implements a communication control with the engine controller 105.

A numeral 403 indicates an image data generating unit that generates the printing information (the bit map data) for an actual printing based on the print data (the code data) transmitted from the external device 101. A numeral 405 indicates image memory for storing image data. A numeral 409 indicates a CPU for controlling video controller 103. ROM 404 stores the control codes of the CPU 409, and RAM 407 functions as a temporary storage means which is used for the CPU 409. A numeral 410 indicates a EEPROM, and is constituted of a nonvolatile memory media.

DMA control unit 408 tranfers the bit map data within the image memory to the engine interface unit 406 by an instruction from the CPU 409. A numeral 412 indicates an option interface (I/F) unit which implements communication with the option controller unit 106 corresponding to an instruction from the CPU 409. Further, option interface (I/F) 412 transmits the POUTT signal 93, the PFEDT signal 94, and the SPCNG signal 95 from the engine interface unit 406 to option controller unit 106 via the generalized interface 90.

A numerical 411 indicates a system bus, and has an address bus and a data bus. The panel interface unit. 401, the host interface unit 402, the image data generating unit 403, the ROM 404, the image memory 405, the engine interface unit 406, the RAM 407, the DMA control unit 408, the CPU 409, the EEPROM 410, and the option interface unit 412 are connected to the system bus 411, respectively, and are accessible to all function units on the system bus 411.

Further, the control codes which control the CPU 409 consist of an OS for time-sharing controlling a plurality of tasks (load module) by a system clock (not shown), and a plurality of tasks which operate in a function unit.

FIGS. 5–9 illustrate a control operation of the image recording apparatus according to the present invention and will now be described. Further, the processes (tasks) shown in FIGS. 5–9, are implemented by the CPU 409 of the video controller 103 based on the programs stored in the ROM, etc.

Figure 7:
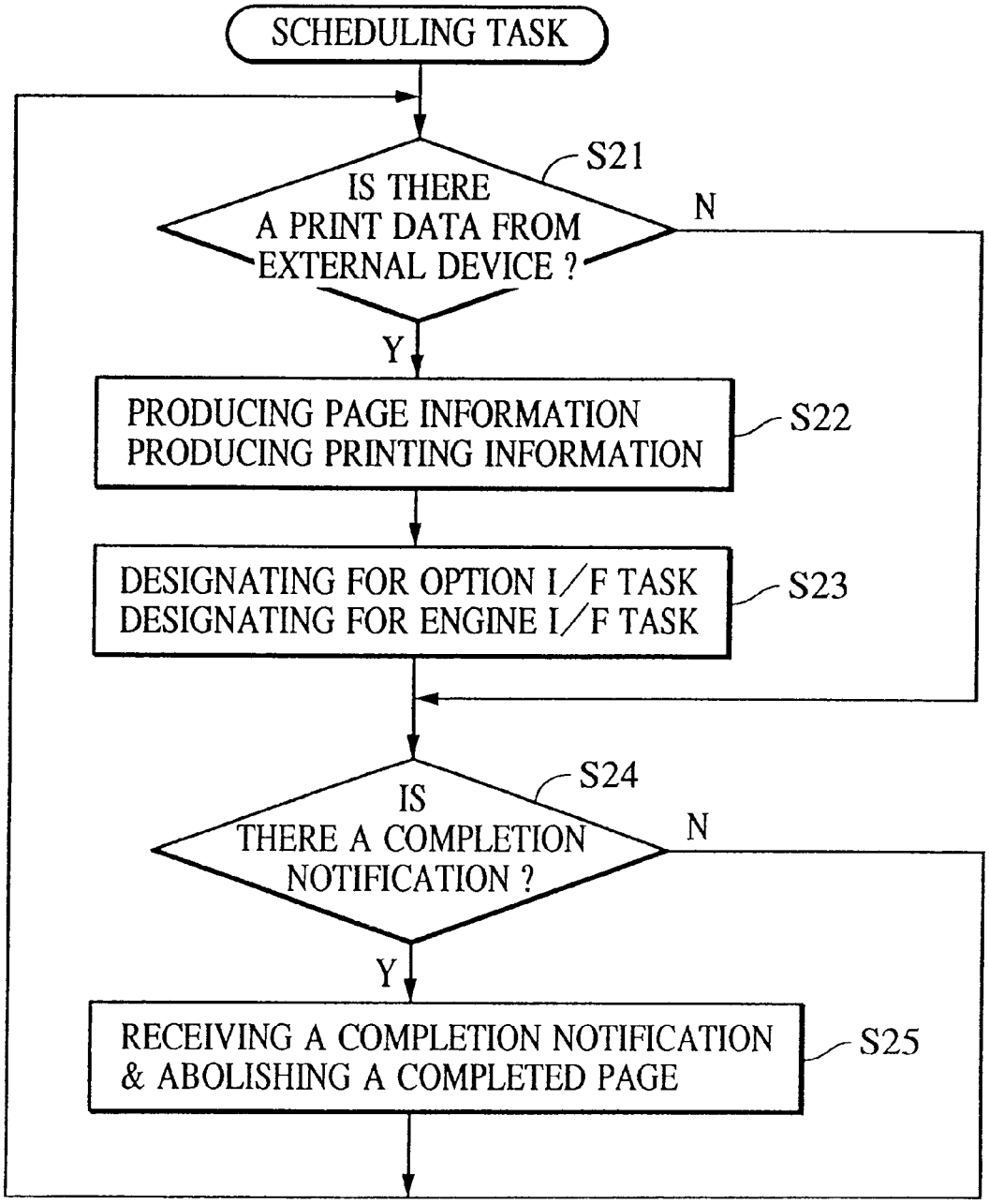
FIG. 7 is a flowchart illustrating a process of a scheduling system (scheduling task) which the video controller shown in FIG. 4 implements a scheduling based on control data and printing data being transferred for an external device.

FIG. 7 is a flowchart illustrating a process of a scheduling task of which the video controller shown in FIG. 4 implements a scheduling based on the print data transferred from the external device 101.

At first, deciding whether or not the print data from the external device 101 such as the host computer is received at the host I/F unit 402 (S21), and in case of the print data being received, producing the page information and the printing information based on the print data received (S22). In this page information, an outlet information is included. In this scheduling task, unless there is an instruction from another task in particular, it is arranged to eject a preceding sheet from the same outlet. Next, print-designating is implemented for the engine I/F task shown in FIG. 8 and for the option I/F task shown in FIG. 9 (each described later) based on the page information and print information produced in step S22, and further each system implements the print-designation for the engine controller 105 and the option controller unit 106 (S23). This print-designation is implemented regardless of a job break.

The scheduling task implements the productions of page information, print information based on the print data transferred from the external device 101, in preceding to an image forming operation by the engine controller 105, as storing the print information expanded to the data bit image data in the image memory 405 as possible.

Accordingly, the engine I/F task, the option I/F task would hold the page information of the completed scheduling for several pages on which image forming has not been made yet.

Next, from the engine I/F task and the option I/F task, for example, monitoring a completion of the paper ejection of the pages of which the printing has been already started, and receiving the notification of the completion (S24), discarding the page information and the print information regarding the completed pages, and implementing a status update process of the designated page for making an empty state of the image memory 405 (S25), and returning to a receiving decision process of the step S21.

On the other hand, in step S21, when there is no receiption of new print data from the external device 101, implementing only the state update process of the designated page of the step S24.

Figure 8:
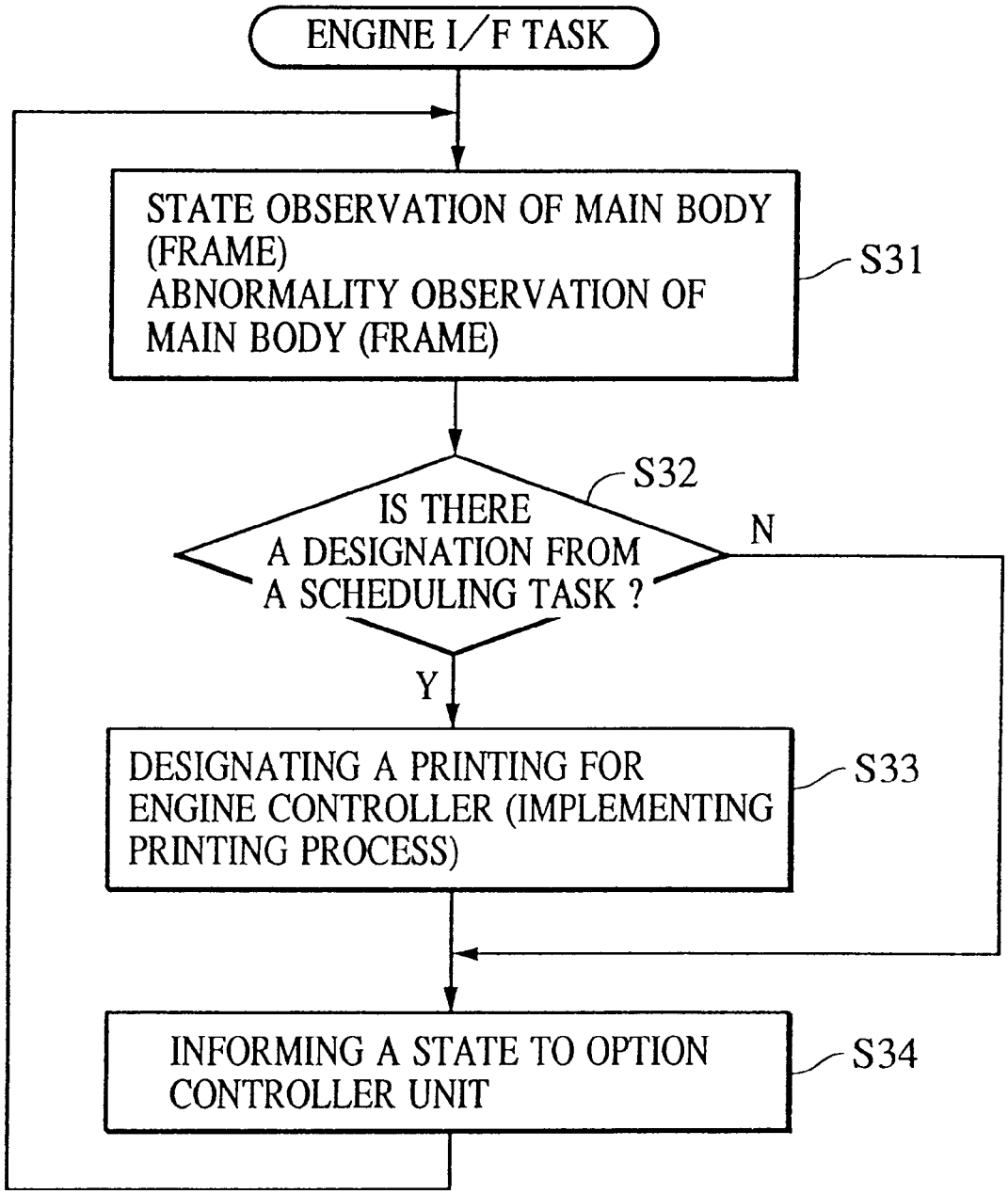
FIG. 8 is a flowchart illustrating a process of an engine interface system (engine I/F task) which implements a printing on a basis of a page information produced by the scheduling system shown in FIG. 7.

FIG. 8 is a flowchart illustrating a process of the engine I/F task which implements the printing based on the page information and the print information produced by the scheduling task shown in FIG. 7.

At first, the engine I/F task implements the state monitoring (printable, etc.) and abnormality monitoring (no paper, door open, paper jam, etc) of the printer main body 102, and notifies to the necessary task. Next, deciding a presence and an absence of the print designation from the scheduling task (S32), and in a case where it is decided that there is a print designation, implementing the print designation to the engine controller 105 through the engine I/F unit 406, and implementing the print process (S33). Further, through the option I/F task shown in FIG. 9, implementing a state notification such as a start of the paper feed, a start of the print to the option controller unit 106 (S34), and then returning to the process of the step S31.

On the other hand, in the step S32, in a case that it is decided that the print designation from the scheduling task is absent, shifting to the state notification process of the step S34.

Figure 9:
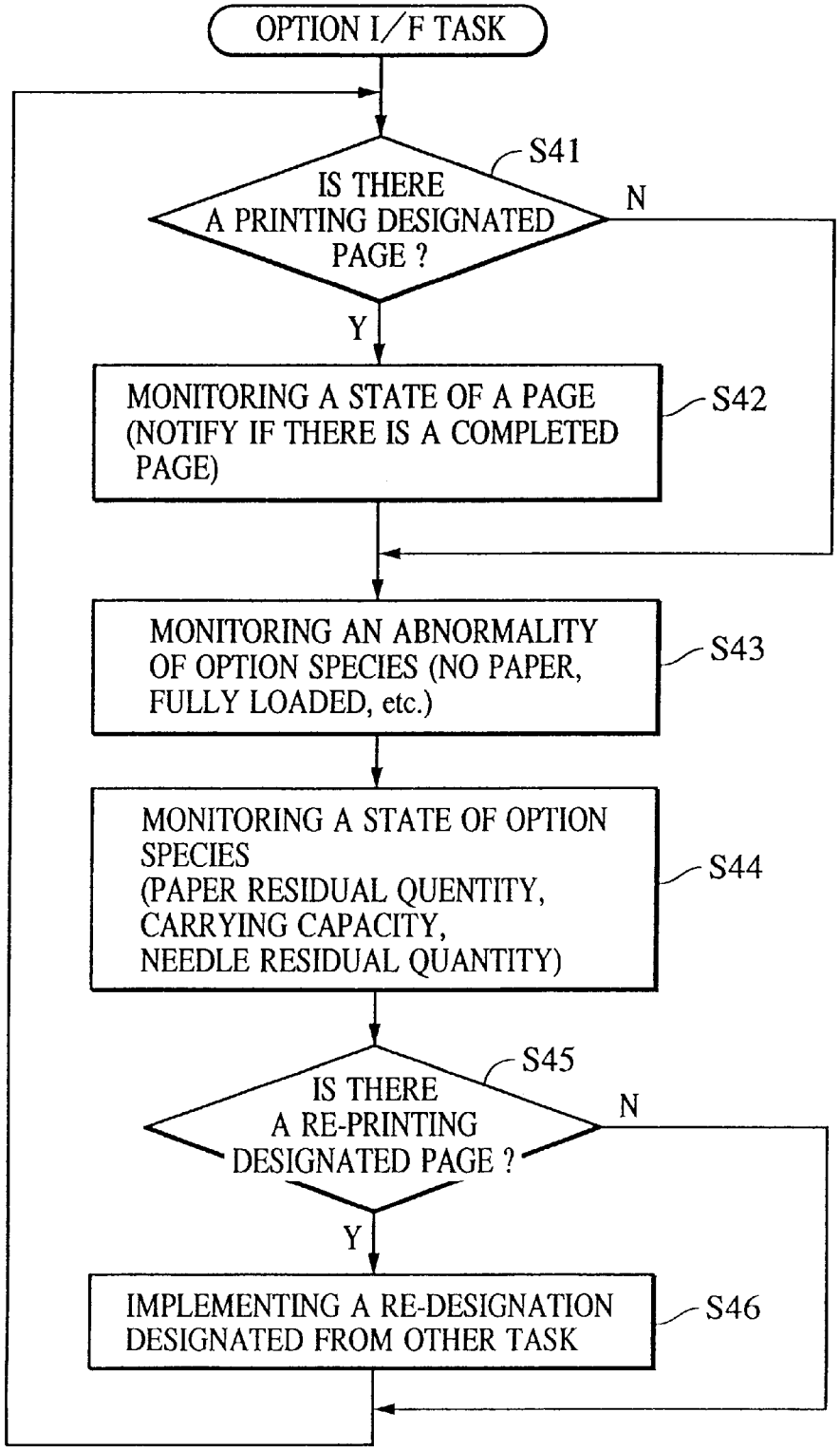
FIG. 9 is a flowchart illustrating a process of an option interface system (option I/F task) which notifies a monitor of a page state designated by the scheduling system shown in FIG. 7 and/or information redesignated from the engine interface system and other systems to an option controller unit.

FIG. 9 is a flowchart illustrating the process of the option I/F task which notifies a monitoring of the page state designated by the scheduling task shown in FIG. 7 and the information redesignated from the engine interface task and other task to the option controller unit 106.

At first, it is decided whether there is a presenece or an absence of a print designated page from the scheduling task (S41), and in a case that it is decided that there is no print designated page, the process skips to step S43.

On the other hand, in step S41, in a case where it is decided that there is a print designated page, implementing a state monitoring of the print designated page, and in a case that there is already the print completed page, notifying to the scheduling task the effect that the information might be abolished (S42).

Next, monitoring for an abnormality of the option types such as no paper, paper jam, full-load, etc., and notifying a necessary system, and outputting an instruction to implement an operator call display, a re-designation execution and the like (S43). Further, monitoring and updating the status monitoring of the option types, for example, the status of the remaining quantity of the sheets of the paper feed option, the load quantity of the paper ejection option, the remaining quantitiy of the needle and the likes, and notifying to the necessary system (S44). Next, receiving a re-designation notification which will be described later from the engine I/F task and the like, deciding whether there is the re-designated data (page) or not (S45), and in a case that it is decided that there is a re-designated data (page), executing the re-designation to the option controller unit 106 through the option I/F unit 412 based on the re-designated data, and then returning to the process of the step S41.

On the other hand, in the step S45, in a case that it is decided that there is no re-designated data (page), by receiving the re-designation notification from the engine interface system and the like, then returning to the process of the step S41.

Moreover, the engine interface system executes a print process based on the re-designation of the step S46.

Figure 5:
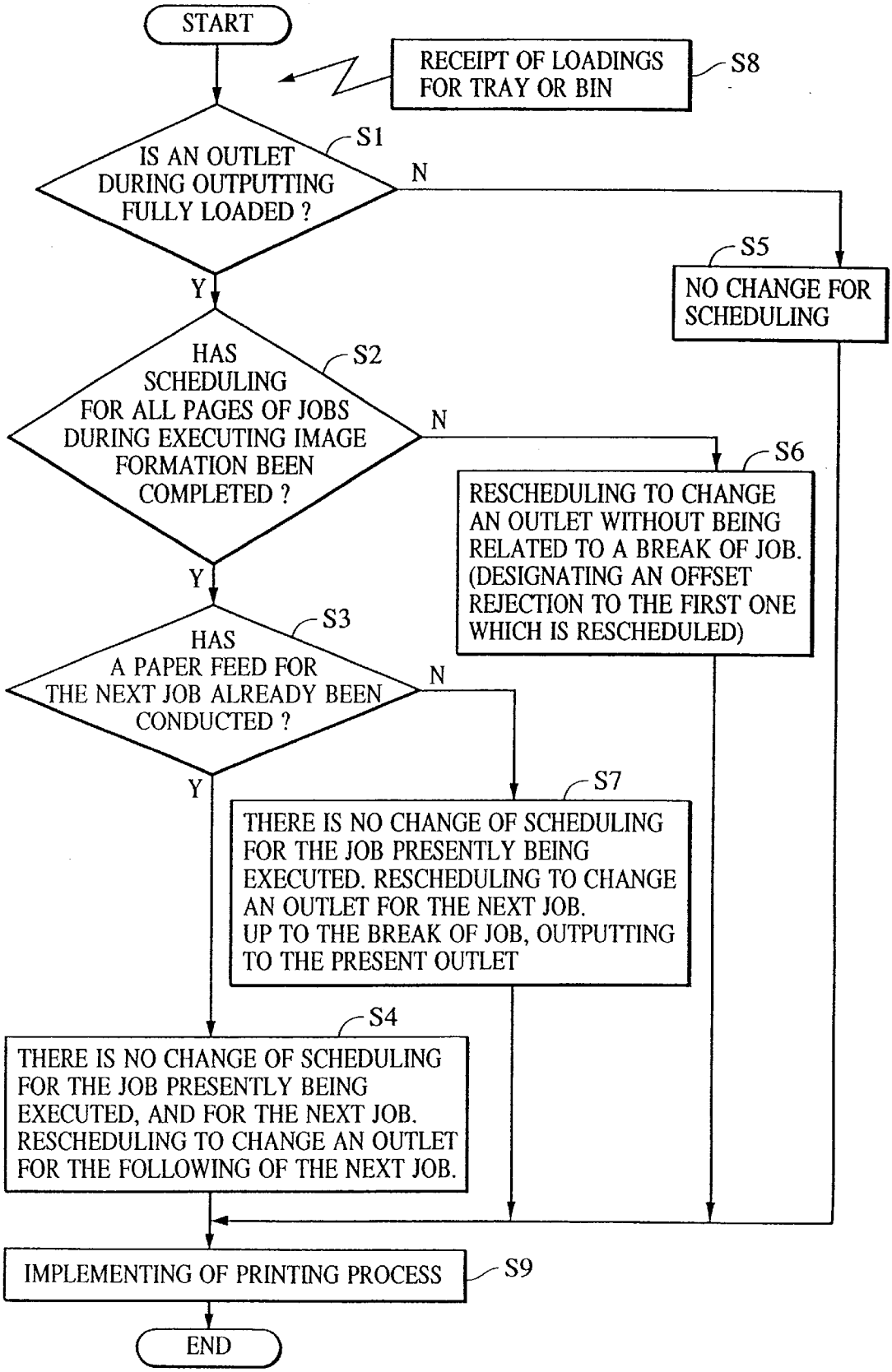
FIG. 5 is a flowchart showing an option control process of an image forming apparatus according to the present invention.

FIG. 5 is a flowchart showing an option control process of the image recording apparatus according to the present invention, and particularly corresponding to an automatic paper ejection mode process which automatically determines an outlet by detecting a load quantity of the outlet and implements an ejection.

At first, there is received the state notification (of which the option controller unit 106 obtains the load quantities detected by the paper ejection sensors 251S, 252S, 253S from the finisher controller 108*a,* and notifies to the video controller 103) of each outlet through the signal or the command statements from the engine controller 105 for the priter main body 102 paper ejection unit (the load tray 213), and from the option controller unit 106 for the option paper ejection unit (the first paper ejection bin 251—the third paper ejection bin 253) (S8), then a decision whether the outlet in the progess of outputting is fully loaded or not is made (S1).

A decision criteria of whether or not the outlet is fully loaded is, as described above, decided in a case where the sheets without staple processed are loaded, when detecting the height of the loaded sheets turned to be 88 mm, and in a case where the sheets with staple processed are loaded, when detecting the height of the loaded sheets turned to be 44 mm. Further, the criteria of this decision of fully loaded is so considered that several tens of sheets could be loaded in that bin after the decision of fully loaded is made.

In a case that it is decided that the outlet in the progess of outputting is not fully loaded, printing is executed (S9) without changing the page information which have already been scheduling with the scheduling task in FIG. 7 (without implementing a change of the outlet) (S5). While scheduling is not being changed, ejecting with the same outlet even if the job is changed to a next job.

On the other hand, in the step S1, in a case that it is decided that the outlet in the progress of outputting is fully loaded, then a decision is made whether or not the scheduling of all pages of the job in the progress of image forming has been finished (S2). In a case that the scheduling of all pages of the job in the progress of image forming has not been finished in the step S2, changing the page information of finished scheduling so as to implement an ejection by changing a designation to another outlet even though it is not a break of a job (however, for a page of which a paper feed has already been started, no scheduling change is made). At that moment, implementing a shift designation to eject by shifting only a first one page to be output to another outlet in a predetermined direction, thereby making a user to understand that the job has been ejected over a plurality of outlets (S6). Next, the process procedes to step S9 where printing is implemented. Moreover, in this case, even if the stapling process has been set, the stapling process is not made, and there is displayed on the panel unit 104 the message that no stapling process will be made. Such as described above, when the apparatus can not decide how many sheets would be ejected from a time of a fully-loaded detection until completing the present job, it is controlled such that the sheets will not to be continuously ejected to a fully-loaded outlet.

In the step S2, a decision is made on whether scheduling of all pages of the job which is currently executed has been already finished, and then it is decided whether or not a paper feed for a next job has been implemented (S3). This is a step for responding to a control of which a paper-feed is made before a job being executed is completed, in a case that the option units of paper feed family are loaded in several levels as described before, and a scheduling of which a paper feed is made from the unit located away from the printer has been set for the next job. That is, if a paper feed of the next job by the option controller unit 106 is started even though the job being executed is not completed, a change of scheduling cannot be made. At least, a change of the outlet for a sheet of the first page of the next job cannot be made. Accordingly, in such a case, it makes a re-scheduling such that an outlet of the following job of the next job is to be changed.

From S3, when the paper-feed for the next job has not been started yet, the process goes to step S7. Here, without changing the scheduling for the job of which the image formation is currently executed, there is a re-scheduling to change an outlet for the next job (S7). Then, implementing of the print process at the step S9 takes place. That is, until the sheets for the job of which the image formation is being executed have been ejected, continuing to eject with the present outlet after having detected the full-load. Accordingly, one job will never be over a plurality of outlets.

In the step S3, when the paper-feed for the next job has already been made, without changing the schedulings for the job being currently executed and for the next job, there is a re-scheduling to change an outlet for the job following the next job.

Figure 6:
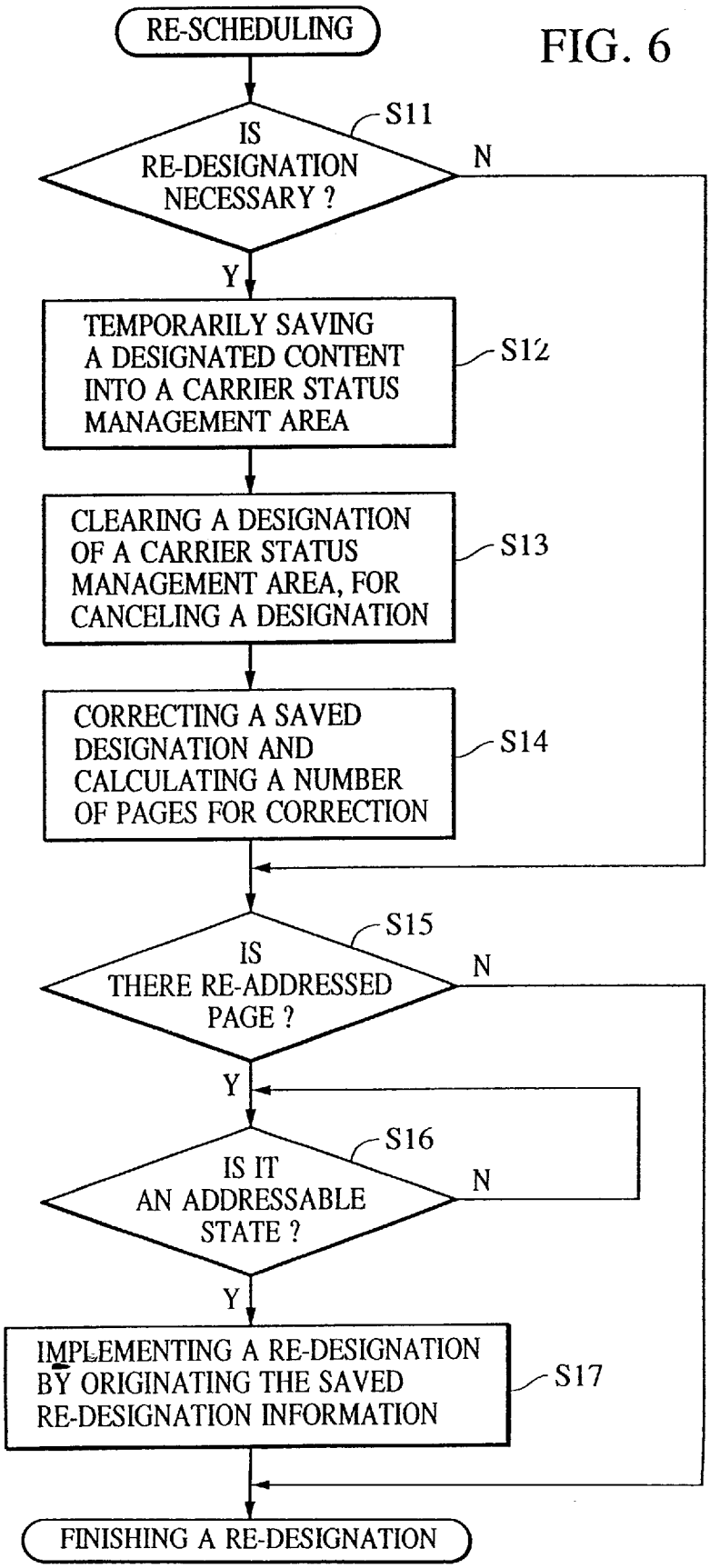
FIG. 6 is a flowchart illustrating a schedule redesignation process which the video controller shown in FIG. 4 implements to an option controller or an engine controller.

FIG. 6 is a flowchart illustrating the re-scheduling steps which the video controller 103 shown in FIG. 4 executes for the option controller unit 106 or the engine controller 105. Further, the processes described in the following are such that the engine I/F task (described later), the option I/F task (described later), the panel unit 104, and the scheduling task and the like detect a full-load, a change of the panel value, no sheet, etc., respectively, thereby implementing a change designation. Here, in particular, a case in which a carrier change designation is to be made is described.

At first, it is decided whether or not a re-designation is necessary by comparing the contents which have already been designated and the contents designated from each of the tasks (S11). Then, in a case where the contents which have already been designated and the contents designated from each of the tasks are the same, and thereby no re-designation is necessary, the process advances to step S15.

On the other hand, in cases where a re-designation is necessary because of the designated contents and the contents designated from each of the systems are different, RAM contents designated to a carrier status management area within the common memory secured in the option controller unit 106 (S12) are temporarily stored in RAM 407. Next, in step S13 the process implements a designation for cancelling the contents which have already been designated, to the option controller unit 106 (i.e., clearing the designation of the carrier status management area) (S13), and then reflecting the change contents designated from each of the systems to the designations saved in the step S12, correcting the saved designations, calculating a number of the redesignated pages (a number of correction pages) and storing them in the RAM 407 (S14).

Next, it is decided whether there is a re-designated page calculated in step S14 (whether or not the number of re-designated pages is "0"), and in a case that it is decided that there is no re-designated page (the number of the re-designated pages is "0"), finishing the process.

On the other hand, in the step S15, in the case where it is decided that there is a re-designated page (the number of re-designated pages is not "0"), it is decided whether a designatable state based on the status notification transmitted from the option controller unit 106 (S16), and in a case that it is decided to be designatable, redesignating a scheduling to the option controller unit 106 (the carrier status management area) based on the designated information saved in the step S12 and the number of the redesignated pages calculated in the step S14 (S17), then finishing the process.

On the other hand, in the step S16, in the case where it is decided to be non-designatable, the process waits until it turns to a designatable state. Further, the non-designatable state corresponds to a state in the middle of implementing the print process, to the pages which have already been designated.

By the above described processes, the output results by the same job can be ejected as being not over a plurality of outlets, and thus it can prevent a user from forgetting to take out his/her own output results.

Further, even when the output results by the same job are ejected over the plurality of outlets, the user can be informed that the ejection is being over the plurality of outlets, as ejecting to the next outlet by shifting the sheets.

Moreover, in cases calling for stapling or the like, not being a staple outout upto a middle because of outlet shift by the full load, a staple output of a unit desired by the user can be absolutely implemented.

Further, by-providing the option controller unit 106 which also gives an instruction to the engine controller 105 by generalizedly controlling a plurality of various types of option units, between the video controller 103 and the engine controller 105, the video controller 103 can use the varous types of option units without increasing the cost of the engine controller 105, by arranging to supply an instruction to the option controller unit 106.

Moreover, the versatility of the connection for the option unit can be enhanced by connecting the option unit with the unifying option unit interface 70, and by identifying and controlling the option unit with the ID. Furthermore, the load of the video controller 103 can be reduced, by having the character data, the image data and the like stored in ROM for the option units, respectively, and by displaying or printing utilizing the data in ROM.

Further, a wide variety of utilization patterns can be provided by an external device or an operator, by forming a virtual unit as the plurality of option units being one unit logically.

Moreover, the danger of an error operation can be reduced by making the information clear to the user, as by providing a display unit in the option units themselves.

Figure 10:
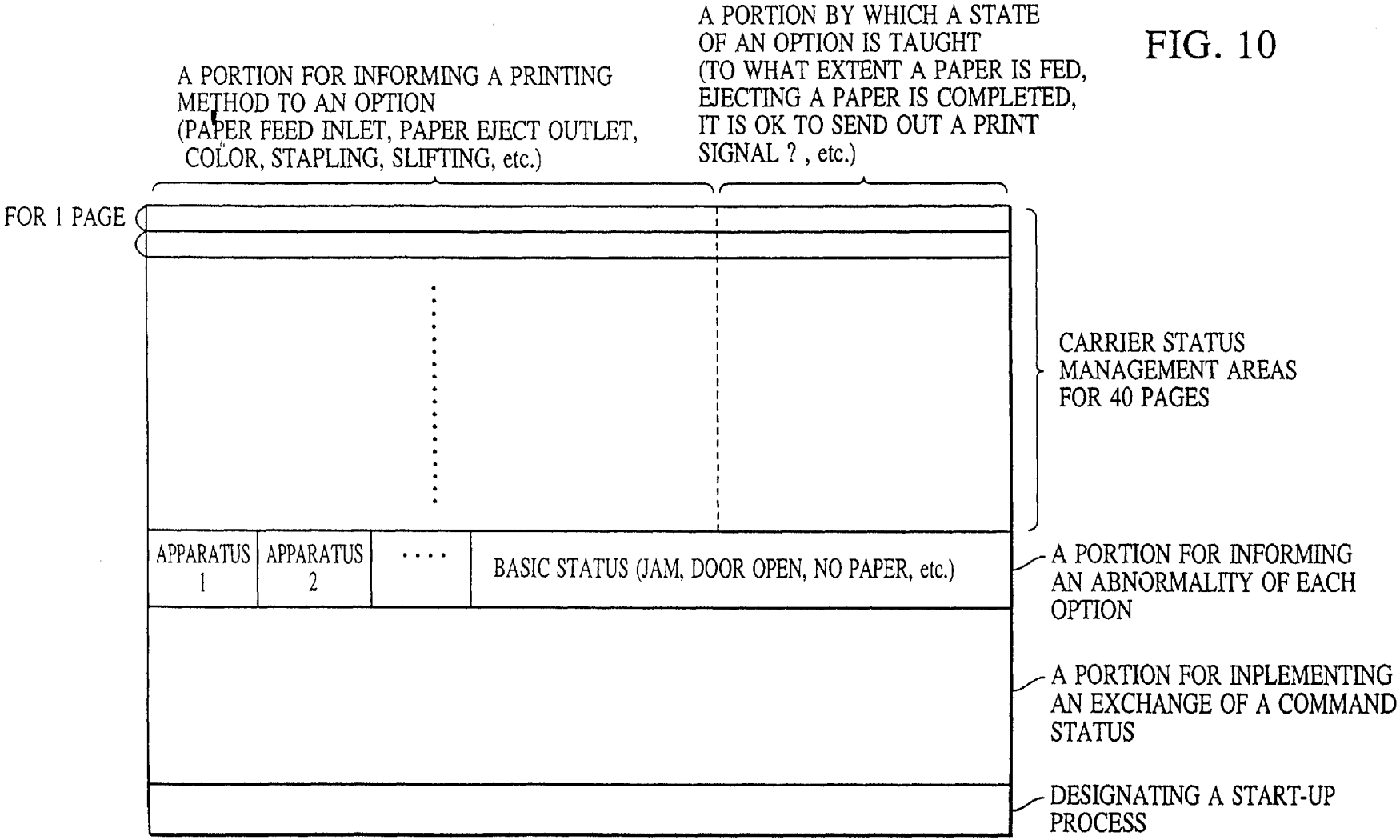
FIG. 10 is a schematic diagram of a common memory with the video controller secured in the RAM installed within the option controller shown in FIG. 1.

FIG. 10 is a schematic diagram of the common memory with the video controller 103 secured in the RAM which is provided within the option controller unit 106 shown in FIG. 1.

The video controller 103 implements designations to each option apparatus through the common memory which is mentioned above.

As described above, the complicated works such that a user locates his/her own ejection results among large amounts of ejection results and a plurality of outlets can be resolved, and an acquisition of the user's output results can be made easily.

[The Second Embodiment]

In the first embodiment described above, there is illustrated the case where a determination of the outlet which ejects a sheet is made by the load quantity of the outlet, but it may be configured as determining an outlet for ejecting based on the sheet size, the monochromatic/color print, and the designated contents for different objects.

[The Third Embodiment]

In the first embodiment described above, it is illustrated for the timing of switching the outlet, by limiting to the case of automatic paper ejection mode that implements an ejection by detecting a load quantity of an outlet and determining an outlet automatically, but in a fixed paper ejection mode which explicitly designates an paper ejection outlet, it may be configured as displaying the full load operator call on the panel 104 with the timing described above, and then judging whether to encourage an involvement of the user (designation of the outlet).

[The Fourth Embodiment]

In the first embodiment described above, it is illustrated for the case that the determination is by job information obtained from the data received by the scheduling system (task) when detecting a break of job, but it may be configured to judge where each job would be broken (at how many pages ahead, there would be a break of job), even before receiving all of the print data, by receiving the number of page of the job in advance as the control data from the external device.

[The Fifth Embodiment]

In the first embodiment described above, there is illustrated the case where the scheduling system implements scheduling on a basis of a sequence of the printer main body 102, by analyzing the printing information to be input for each job, and for the paper ejection option apparatus 108, a print processing by designating an outlet for ejecting the sheets for each job, implementing a rescheduling which changes the outlet by detecting the full load and the like of the outlet, and then redesignating the outlet. However, the embodiment may also be configured as implementing a scheduling on a basis of a sequence of the printer main body 102, implementing a print process by designating a paper feed source (a paper feed source of the paper feed option apparatus which is capable of attaching with multi-loads on the printer main body, the printer main body 102 bottom) for paper-feeding the sheets for each job, for the paper-feed option apparatus 107, and then redesignating the paper-feed source (capable of paper-feeding the sheets in the same or in the differenct sizes) by rescheduling so as to change the paper-feed source in case remaining quantity of the recording sheets is exhausted.

Further, the paper-feed option appartus which is capable of attaching with multi-loads on the bottom of the printer main body 102 is not limited to the paper deck option unit 107 with a large capacity as shown in FIG. 2, but it may be an apparatus such as the one which has a plurality of sheet cassettes and is capable of selective paper feeding of a plurailty types of sheets.

Moreover, in the first embodiment described above, the sheets are ejected to the next outlet by shifting the sheet, in the case where the output results by the same job are ejected over a plurality of outlets, but it may also be configured as ejecting to the next outlet by reversing the sheet by a reverse roller, and notifying the user that the ejection is over a plurality of outlets whenever the output results by the same job are ejected over a plurality of outlets.

Further, the image recording apparatus according to the present invention is not limited to a laser beam printer, and it is apparent that it may be a printer of other print types such as an inkjet printer. Also, there is illustrated the case of two option units being connected, but more option units can be connected, and the functions of option units may be shared with the main body.

According to the above described process, the output results by the same job can be ejected as not being over a plurality of outlets, thus the user will seldom forget to take out his/her own output results. Also, cases where the output results by the same job are ejected over a plurality of outlets, as when ejecting to the next outlet by shifting the sheet, it enables notification of the user that the ejection is over the plurality of outlets.

Moreover, in a case of implementing a staple and the like, not being a staple output upto a middle because of outlet shift by the full load, a staple output of a unit desired by the user can be absolutely implemented.

[The Sixth Embodiment]

In the first embodiment described above, there is illustrated the example where a sensor (the paper-ejection load quanty detection sensors 251S–253S) is provided for each paper-ejection bin to detect the load quantity of each paper-ejection bin, thereby detecting the load quantities of the first paper ejection bin 251—the third paper ejection bin 253 of the paper ejection option apparatus 108. However, it may also be configured by providing only one sensor near the outlet to detect the load quantity of each bin by shifting each bin. In the following, that embodiment will be described.

Figure 11:
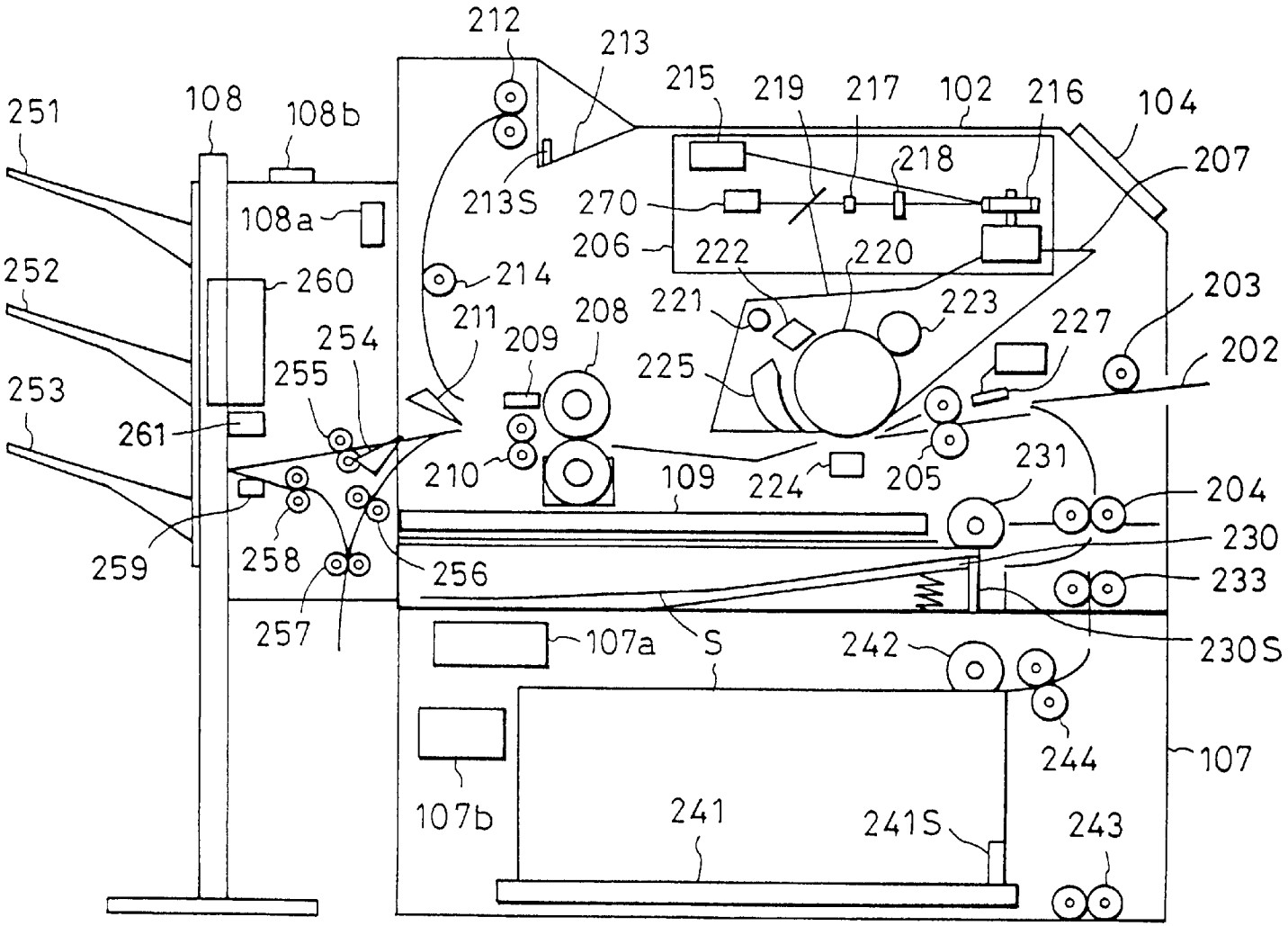
FIG. 11 is a cross-sectional view illustrating a configuration of an image forming apparatus showing a sixth embodiment according to the present invention.

FIG. 11 is a cross-sectional view illustrating a configuration of the image recording apparatus shown in the sixth embodiment of the present invention, and the same elements in FIG. 2 are marked with the same symbols.

In the figure, a numeral 261 indicates a paper-ejection load quantity detection sensor, and detects the load quantity of the recording sheets to be paper-ejected to the first paper ejection bin 251 through the third paper ejection bin 253 which ascend and descend by the bin ascent and descent motor 260.

Further, the paper-ejection load quantity detection sensor 261 is a height sensor, and the finisher controller 108 notifies the video controller 103 of the full-load through the option controller unit 106 at the time when the heights of the recording sheets loaded on the first paper ejection bin 251 through the third paper ejection bin 253 have been reached (detected) to, for example, 88 mm (corresponding to about 700 sheets).

Moreover, the first paper ejection bin 251 through the third paper ejection bin 253 are capable of loading about 2000 sheets in the 3 bins, but in the case where stapled sheets are being loaded, because there is a fear of the collapse at a time of the bin shifting by the bin ascent and descent motor 260, the detection criteria of the full load of the sheets to be loaded on each bin is a half of the usual case (herein, it is 88 mm), 44 mm.

As described above, according to a configuration that detects the load quantity of the paper ejection sheets loaded on the plurality of bins, with only one sensor, as reducing the cost, the similar effect as the first embodiment described above can be obtained.

Such as described above, it is apparent that the object of the present invention can be achieved by, supplying a storage media in which program code which implements the functions of the above described embodiments is recorded, to a system or an apparatus, by which a computer (or CPU, MPU) of the system or the apparatus reads and executes the program code stored in the storage media.

In this case, the program code read from the storage media implements novel features the present invention, and the storage media which stores the program code constitutes the present invention.

As the storage media for supplying the program codes, for example, a floppy disk, a hard disk, an optical disk, a magneto-optic disk, a CD-ROM, CD-R, a magnetic tape, a nonvolatile memory card, a ROM, an EEPROM, and the like can be used.

Furthermore, by executing the program code read by the computer, the instructions of the program code, the OS (Operating System) and the like being operated on the computer implement a portion of or all of the actual processes, and by these processes the functions of the above described embodiments are implemented.

Further, it is apparent that after the program codes read from the storage media have been written in the memory provided in a feature expansion board inserted in the computer or provided in a feature expansion unit connected to the computer, based on the instructions of the program codes, a CPU and the like provided in the feature expansion board or the feature expansion unit implements a portion of or all of the actual processes, and by these processes the functions of the above described embodiments are implemented.

Moreover, the present invention may be applied to a system which is constituted of a plurality of devices, or to an apparatus constituted of one device. Also, it is apparent that the present inveniton may be applied to the cases which may be achieved by providing the program to the system or the apparatus. In these cases, by reading the storage media in which the program represented by the software for achieving the present invention has been stored to the system or the apparatus, these system or apparatus can have the effects of the present invention Further, by downloading and reading the program represented by the software for achieving the present invention from the database on the network with the communication program, these system or apparatus can have the effects of the present invention.

While the present invention has been described with respect to what is presently considered to be the preferred embodiments, it is to be understood that the invention is not limited to the disclosed embodiments. The present invention is intended to cover the various modifications and equivalent arrangements included within the spirit and scope of the appended claims.

What is claimed is:

1. An image forming apparatus, having image forming means for forming an image on a sheet based on inputted data and ejecting means for ejecting the sheet on which the image is formed by said image forming means to a first loading unit or a second loading unit, in which, when a load quantity of the first loading unit reaches a predetermined load quantity while a plurality of sheets with formed images on them are being continuously ejected to the first loading unit, then a sheet can be ejected successively to the second loading unit, comprising:

controlling means for ejecting the sheet to said second loading unit in a different ejecting way from the sheets ejected to said first loading unit when the sheet to be ejected to said second loading unit is a part of the same job as the sheets ejected to said first loading unit.

2. An image forming apparatus according to claim 1, wherein, when the sheet to be ejected to said second loading unit is a part of the same job as those ejected to said first loading unit, said controlling means shifts the sheet in a predetermined direction and ejects it to said second loading unit.

3. An image forming apparatus according to claim 1, wherein, when the sheet to be ejected to said second loading unit is a part of the same job as those ejected to said first loading unit, said controlling means turns over the sheet and ejects it to said second loading unit.

4. A controlling apparatus for controlling an image forming apparatus, in which an image is formed on a sheet based on inputted data and, when a load quantity of a first loading unit reaches a predetermined load quantity while a plurality of sheets with formed images on them are being continuously ejected to the first loading unit, then a sheet can be ejected successively to a second loading unit, comprising:

controlling means for ejecting sheets to said second loading unit in a different ejecting way from those ejected to said first loading unit when the sheet to be ejected to said second loading unit is a part of the same job as those sheets ejected to said first loading unit.

5. A controlling apparatus according to claim 4, wherein, when the sheet to be ejected to said second loading unit is a part of the same job as those ejected to said first loading unit, said controlling means shifts the sheet in a predetermined direction and eject it to said second loading unit.

6. A controlling apparatus according to claim 4, wherein, when the sheet to be ejected to said second loading unit is a part of the same job as those ejected to said first loading unit, said controlling means turns over the sheet and ejects it to said second loading unit.

7. A control method for controlling an image forming apparatus, in which an image is formed on a sheet based on inputted data and, when a load quantity of a first loading unit reaches a predetermined load quantity while a plurality of sheets with formed images on them are being continuously ejected to the first loading unit, then a sheet can be ejected successively to a second loading unit, comprising the controlling step of:

ejecting sheets to said second loading unit in a different ejecting way from the sheets ejected to said first loading unit when the sheet to be ejected to said second loading unit is a part of the same job as those ejected to said first loading unit.

8. A control method according to claim 7, wherein, in the controlling step, when the sheet to be ejected to said second loading unit is a part of the same job as those ejected to said first loading unit, said controlling means shifts the sheet in a predetermined direction and ejects it to said second loading unit.

9. A control method according to claim 7, wherein, in the controlling step, when the sheet to be ejected to Said second loading unit is a part of the same job as those ejected to said first loading unit, said controlling means turns over the sheet and ejects it to said second loading unit.

10. An image forming apparatus, having image forming means for forming an image on a sheet based on inputted data and ejecting means for ejecting the sheet with the image formed by said image forming means to a first loading unit or a second loading unit, in which, when a load quantity of the first loading unit reaches a predetermined load quantity while a plurality of sheets with formed images on them are being continuously ejected to the first loading unit, then a sheet can be ejected successively to the second loading unit, comprising:

controlling means for prohibiting a stapling process for the sheets when the sheet to be ejected to said second loading unit is a part of the same job as those ejected to said first loading unit.

11. An image forming apparatus according to claim 10, wherein said image forming apparatus has displaying means, and, when said controlling means prohibits the stapling process for the sheets, said controlling means causes said displaying means to display an indication of that state.

12. A controlling an image forming apparatus, in which an image is formed on a sheet based on inputted data and, when a load quantity of a first loading unit reaches a predetermined load quantity while a plurality of sheets with formed images on them are being continuously ejected to the first loading unit, then a sheet can be ejected successively to a second loading unit, comprising:

controlling means for prohibiting a stapling process for the sheets when the sheet to be ejected to said second loading unit is a part of the same job as those ejected to said first loading unit.

13. A controlling apparatus according to claim 12, wherein the above image forming apparatus has display means and, when said controlling means prohibits the stapling process for the sheets, said controlling means causes said display means to display an indication of that state.

14. A control method for controlling an image forming apparatus, in which an image is formed on a sheet based on inputted data and, when a load quantity of a first loading unit reaches a predetermined load quantity while a plurality of sheets with formed images on them are being continuously ejected to the first loading unit, then a sheet can be ejected successively to a second loading unit, comprising:

a controlling step for prohibiting a stapling process for the sheets when the sheet to be ejected to said second loading unit is a part of the same job as those ejected to said first loading unit.

15. A control method according to claim 14, wherein said image forming apparatus has displaying means, and in the above controlling step, when the stapling process for the sheets is prohibited, an indication of that state is displayed by said displaying means.

16. An image forming apparatus, having image forming means for forming an image on a sheet based on inputted data and ejecting means for ejecting the sheet on which the image is formed to a loading unit, comprising:

controlling means for determining whether the remaining sheets of one job should also be ejected to said loading unit on the basis of the state of the job processing by said image forming apparatus when a load quantity of the loading unit reaches a predetermined load quantity while a plurality of sheets of the job are being continuously ejected to the loading unit.

17. An image forming apparatus according to claim 16, wherein, whenever said controlling means can determine how many pages ahead the last page of the job is located, said controlling means ejects also the rest of sheets of the job to said loading unit and, when said controlling means cannot determine how many pages ahead the last page of the job is located, said controlling means prevents ejection of the remaining sheets of the job to said loading unit.

18. An image forming apparatus according to claim 17, wherein said image forming apparatus can eject the sheet with the formed image to any of a plurality of loading units and, when said controlling means prevents ejection of the remaining sheets of the job to said loading unit, said controlling means ejects the rest of sheets of the job to the other loading unit which is different from said loading unit.

19. An image forming apparatus according to claim 18, wherein, when said controlling means ejects the remaining sheets of the job to the other loading unit which is different from said loading unit, said controlling means ejects the remaining sheets by shifting them to a predetermined direction.

20. An image forming apparatus according to claim 18, wherein, when said controlling means ejects the remaining sheets of the job to the other loading unit which is different from said loading unit, said controlling means prohibits a stapling process for the sheets of the job.

21. An image forming apparatus according to claim 20, wherein said image forming apparatus has displaying means, and, when said controlling means prohibits the stapling process for the sheets of the job, said controlling means causes said displaying means to display an indication of that state.

22. A controlling apparatus, for controlling an image forming apparatus for forming an image on a sheet based on inputted data for ejecting the sheet on which the image is formed to a loading unit, comprising:

controlling means for determining whether the remaining sheets of one job should also be ejected to said loading unit, on the basis of the state of the job processing by said image forming apparatus when a load quantity of the loading unit reaches a predetermined load quantity while a plurality of sheets of the job are being continuously ejected to the loading unit.

23. A controlling apparatus according to claim 22, wherein, when said controlling means can determine how many pages ahead the last page of the job is located, said controlling means ejects also the remaining sheets of the job to said loading unit and, when said controlling means cannot determine how many pages ahead the last page of the job is located, said controlling means prevents ejection of the remaining sheets of the job to said loading unit.

24. A controlling apparatus according to claim 23, wherein said image forming apparatus can eject the sheet with the formed image to any of a plurality of loading units and, when said controlling means prevents ejection of the remaining sheets of the job to said loading unit, said controlling means ejects the remaining sheets of the job to the other loading unit which is different from said loading unit.

25. A controlling apparatus according to claim 24, wherein, when said controlling means ejects the remaining sheets of the job to the other loading unit which is different from said loading unit, said controlling means ejects the remaining sheets by shifting them to a predetermined direction.

26. A controlling apparatus according to claim 24, wherein, when said controlling means ejects the remaining sheets of the job to the other loading unit which is different from said loading unit, said controlling means prohibits a stapling process for the sheets of the job.

27. A controlling apparatus according to claim 26, wherein said image forming apparatus has displaying means, and, when said controlling means prohibits the stapling process for the sheets of the job, said controlling means makes displaying means display that state.

28. A control method, for controlling an image forming apparatus for forming an image on a sheet based on inputted data and for ejecting the sheet on which the image is formed to a loading unit, comprising:

controlling steps for determining whether the remaining sheets of one job should also be ejected to said loading unit on the basis of the state of job processing by said image forming apparatus when a load quantity of the loading unit reaches a predetermined load quantity while a plurality of sheets of the job are being continuously ejected to the loading unit.

29. A control method according to claim 28, wherein, when said controlling steps can determine how many pages ahead the last page of the job is located, said controlling steps elect also the remaining sheets of the job to said loading unit and, when said controlling steps cannot determine how many pages ahead the last page of the job is located, said controlling steps prevent ejection of the remaining sheets of the job to said loading unit.

30. A control method according to claim 29, wherein, said image forming apparatus can eject a sheet on which an image is formed to any of a plurality of loading units and, in said controlling step, when ejection of the remaining sheets of the job to said loading units is prohibited, the remaining sheets of the job are ejected to the other loading unit which is different from said loading unit.

31. A control method according to claim 30, wherein, in said controlling step, when the remaining sheets of the job are ejected to the other loading unit which is different from said loading unit, the remaining sheets are ejected by shifting them to a predetermined direction.

32. A control method according to claim 30, wherein, in said controlling step, when the remaining sheets of the job are ejected to the other loading unit which is different from said loading unit, a stapling process to the sheets of the job is prohibited.

33. A control method according to claim 32, wherein said image forming apparatus has displaying means, and, in said controlling step, when the stapling process for the sheets of the job is prohibited, an indication of that state is displayed by said displaying means.

34. A storage medium having stored thereon machine readable program code for controlling an image forming apparatus, the apparatus, in accordance with a load quantity of a first loading unit having reached a predetermined load quantity, able to continuously eject sheets on a second loading unit, while a plurality of sheets with images thereon are continuously ejected to the first loading unit, after images are formed on sheets, based on input data, the program having a controlling step of ejecting sheets to said second loading unit in a different ejecting way from the sheets ejected to first loading unit when the sheets to be ejected to said second loading unit are a part of the same job as the sheets ejected to said first loading unit.

35. A storage medium according to claim 34, wherein, in the controlling step, when the sheet to be ejected to said second loading unit is a part of the same job as those ejected to said first loading unit, said controlling step shifts the sheet in a predetermined direction and ejects it to said second loading unit.

36. A storage medium according to claim 34, wherein, in the controlling step, when the sheet to be ejected to said second loading unit is a part of the same job as those ejected to said first loading unit, said controlling steps turns over the sheet and ejects it to said second loading unit.

37. A storage medium having stored thereon machine readable program code for controlling an image forming apparatus, the apparatus, in accordance with a load quantity of a first loading unit having reached a predetermined load quantity, able to continuously eject sheets on a second loading unit, while a plurality of sheets with images thereon are continuously ejected to the first loading unit, after images are formed on sheets, based on input data, the program having a controlling step for prohibiting a stapling process for the sheets when the sheets to be ejected to said second loading unit are a part of the same job as the sheets ejected to said first loading unit.

38. A storage medium according to claim 37, wherein said image forming apparatus has displaying means, and in the above controlling step, when the stapling process for the sheets is prohibited, an indication of that state is displayed by said displaying means.

39. A storage medium having stored thereon machine readable program code for controlling an image forming apparatus, which eject sheets with images thereon to a loading unit after the images are formed on the sheets, the images formed based on input data, the program having a controlling step for determining whether remaining sheets to one job should also be ejected to said loading unit on the basis of a state of job processing by said image forming apparatus when a load quantity of the loading unit reaches a predetermined load quantity while a plurality of sheets of the job are being continuously ejected to the loading unit.

40. A storage medium according to claim 39, wherein, when said controlling step can determine how many pages ahead the last page of the job is located, said controlling step also ejects the remaining sheets of the job to said loading unit and, when said controlling step cannot determine how many pages ahead the last page of the job is located, said controlling step prevents ejection of the remaining sheets of the job of said loading unit.

41. A storage medium according to claim 40, wherein said image forming apparatus can eject a sheet on which an image is formed to any of a plurality of loading units and, in said controlling step, when ejection of the remaining sheets of the job to said loading units is prohibited, the remaining sheets of the job are ejected to an other loading unit which is different from said loading unit.

42. A storage medium according to claim 41, wherein, in said controlling step, when the remaining sheets of the job are ejected to the other loading unit which is different from said loading unit, the remaining sheets are ejected by shifting them to a predetermined direction.

43. A storage medium according to claim 41, wherein, in said controlling step, when the remaining sheets of the job are elected to the other loading unit which is different from said loading unit, a stapling process to the sheets of the job is prohibited.

44. A storage medium according to claim 43, wherein said image forming apparatus has displaying means, and, in said controlling step, when the stapling process for the sheets of the job is prohibited, an indication of that state is displayed on a display.

* * * * *

UNITED STATES PATENT AND TRADEMARK OFFICE

CERTIFICATE OF CORRECTION

PATENT NO. : 6,240,273 B1
DATED : May 29, 2001
INVENTOR(S) : Nobuyoshi Kakigi

It is certified that error appears in the above-identified patent and that said Letters Patent is hereby corrected as shown below:

Column 1,
Line 36, "an" should read -- a --.
Line 48, unit," should read -- units, --.

Column 4,
Line 62, "FIG. I" should read -- FIG. 1 --.

Column 7,
Line 24, "transmite" should read -- transmitted --.

Column 9,
Line 8, "unit. 401," should read -- unit 401, --.

Column 10,
Line 26, "task" should read -- tasks --.
Line 27, "presenece" should read -- presence --.
Line 45, "likes," should read -- like, --.

Column 11,
Line 49, "can not" should read -- cannot --.
Line 52, "to be" should read -- be --.

Column 13,
Line 19, "by-providing" should read -- by providing --.

Column 14,
Line 2, "an" should read -- a--.
Line 39, "apparatus" should read -- apparatus --.

Column 15,
Line 10, "quanty" should read -- quantity --.

Column 16,
Line 28, "system" should read -- systems --.

Column 17,
Line 13, "eject" should read --ejects --.
Line 40, "Said" should read -- said --.
Line 64, "controlling" should read -- controlling apparatus for controlling --.

UNITED STATES PATENT AND TRADEMARK OFFICE

CERTIFICATE OF CORRECTION

PATENT NO. : 6,240,273 B1
DATED : May 29, 2001
INVENTOR(S) : Nobuyoshi Kakigi

It is certified that error appears in the above-identified patent and that said Letters Patent is hereby corrected as shown below:

Column 19,
Line 61, "elect" should read -- eject --.

Column 20,
Line 43, "steps" should read -- step --.
Line 64, "eject" should read -- ejects --.

Column 22,
Line 1, "an other" should read -- another --.
Line 9, "elected" should read -- ejected --.

Signed and Sealed this

Fourth Day of December, 2001

*Attest:*

Nicholas P. Godici

*Attesting Officer*

NICHOLAS P. GODICI
*Acting Director of the United States Patent and Trademark Office*